United States Patent [19]

Turnier

[11] 4,162,788

[45] Jul. 31, 1979

[54] SWIMMING AND EXERCISING APPARATUS

[76] Inventor: Gerard Turnier, 61-35 98th St., Rego Park, N.Y. 11374

[21] Appl. No.: 816,336

[22] Filed: Jul. 18, 1977

[51] Int. Cl.[2] ..... A63B 35/04

[52] U.S. Cl. ..... 272/71; 115/23

[58] Field of Search ..... 272/71, 26, 73, 1 B; 35/29 B; 9/301, 310 J; 280/211, 259, 261; 115/21, 23, 25, 27, 2, 22.3, 26.3, 22.1, 22.2, 66, 70; 128/25 R, 25 B

[56] References Cited

U.S. PATENT DOCUMENTS

| | | | |
|---|---|---|---|
| 632,276 | 9/1899 | Oltmann | 115/2 |
| 1,030,525 | 6/1912 | Myers | 115/22.3 |
| 2,020,992 | 11/1935 | Caplan | 128/25 R |
| 2,033,275 | 3/1936 | Campbell | 272/71 |
| 2,257,698 | 9/1941 | McCombie | 115/23 |
| 2,332,184 | 10/1943 | Sweeney | 272/71UX |
| 3,373,992 | 3/1968 | Ludeman | 272/73 |

*Primary Examiner*—Richard T. Stouffer
*Assistant Examiner*—Arnold W. Kramer

[57] ABSTRACT

Swimming and exercising apparatus is disclosed comprising a body supporting section having wheels with cog-like driving members thereon secured to the body supporting section at either end through wheel supporting frames. The wheels are positioned on either end in pairs, each of the wheels being individually driven by pedals. A pair of pedals are positioned at one end of the body supporting section and a pair of pedals are positioned at the opposite end of the body supporting section, each of the pedals drivingly engaging a wheel. The wheels are mounted on crossbars extending across the frame sections, each crossbar lying in the horizontal plane parallel to the body supporting section, one of the horizontal planes extending a greater distance from the body supporting section than the other.

A pair of removable braces are provided, one end of the braces being secured to the body supporting section, the other end of which may be secured to a wall. The ends of the removable braces that are secured to a wall lie in a plane parallel to a horizontal plane normal to the outer edges of the wheels.

4 Claims, 2 Drawing Figures

SWIMMING AND EXERCISING APPARATUS

SUMMARY OF THE INVENTION

The present invention relates to swimming and exercising apparatus comprising a substantially flat body supporting section. First and second frame sections extend from opposite ends of the body supporting section. Each of the frame sections comprises a pair of lateral arms secured at one end thereof to the body section, a crossbar joining the other ends of the lateral arms. Wheel members are rotatably mounted on each crossbar of each of the frame sections. Cog members extend from the periphery of each of the wheel members for drivingly engaging water or a planar surface which the wheel members may engage. First and second pedal members are mounted substantially at the ends of the body supporting sections in the area where the first and second frame sections extend from a body supporting section. The first pedal member is arranged to be operated by the hands and the second pedal member is arranged to be operated by the feet. The first pedal member is drivingly connected to the wheel members on the first frame and the second pedal member is drivingly connected to the wheel members on the second frame.

The crossbar of the first frame lies in a first horizontal plane parallel to the plane of the body supporting sections. The crossbar of the second frame lies in a second horizontal plane parallel to the plane of the body supporting section. The second horizontal plane is closer to the plane of the body supporting section than the first horizontal plane.

The wheel members comprise a pair of opposed wheels on the crossbar of the first frame and a pair of opposed wheels on the crossbar of the second frame. The first pedal member comprises individual pedals individually driving each of the wheels on the first frame and the second pedal members comprise individual pedals individually driving each of the wheels on the second frame so that greater or lesser exercising forces may be applied independently to each of the wheels.

Bracket members for mounting the apparatus on a vertical wall are provided so that the apparatus may be employed as an exercising machine for vertically exercising arm and leg muscles.

The diameter of the wheel members may be the same for each of the wheels employed on the apparatus.

The pair of bracket members may comprise removable brackets for mounting the apparatus on a vertical wall and extend from one end secured to the body supporting section and terminate at an opposite end on the same side of the body supporting section. The opposite end of the removable bracket members lie in a common plane parallel to a plane normal to the periphery of the wheel members.

DETAILED DESCRIPTION

Exercising and/or swimming apparatus is disclosed in the prior art U.S. Pat. Nos. Fee 3,375,801; Johnson 2,139,022; Chaligne 1,728,103; Gordon 1,667,778; Helm 1,610,778; Kupsche 1,457,908; Moore 1,086,608 and Sandberg 1,005,478.

It is an object of the present invention to provide novel swimming and exercising apparatus.

It is a further object of the present invention to provide swimming and exercising apparatus comprising cog wheels secured at opposite ends of a body supporting section in which the cog wheels are individually driven by pedals so that greater or lesser exercising forces may be applied independently to each of the wheels to enable groups of muscles requiring a greater or lesser amount of exercise to be exercised independently of other similar muscles in the body.

These and other objects have been achieved according to the present invention and will become apparent by reference to the disclosure and claims that follow as well as the appended drawing.

Figure 1:
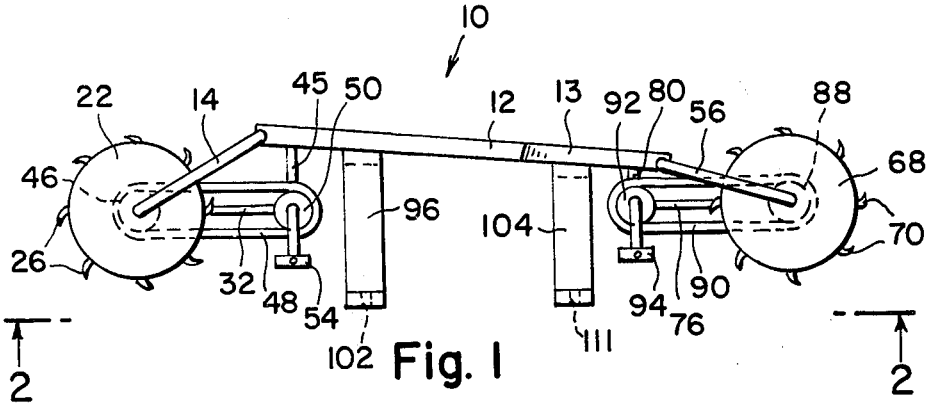
FIG. 1 comprises a side elevation illustrating a swimming and exercising apparatus according to one embodiment of the present invention.
Figure 2:
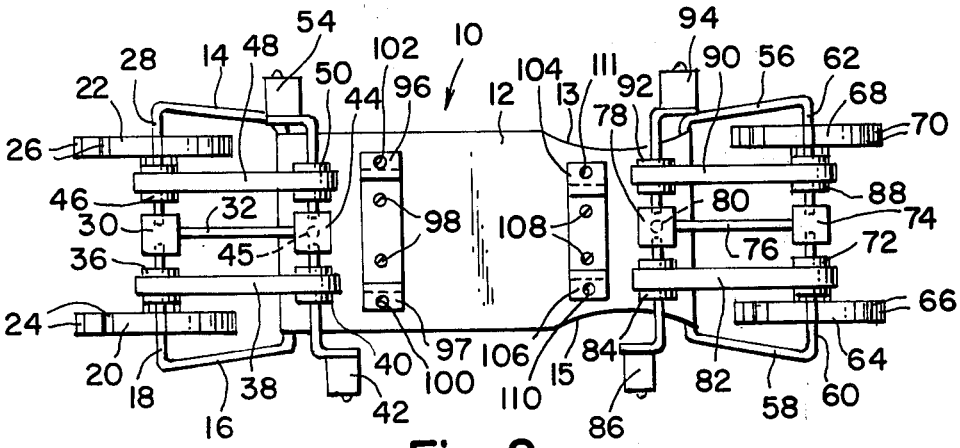
FIG. 2 comprises a bottom plan view taken along the line 2—2 from FIG. 1.

Referring to the drawing and FIGS. 1 and 2 therein, a swimming and exercising apparatus 10 is illustrated comprising a body supporting section 12 having frames extending from either end for supporting wheel members. The frames comprise frame section 16 and 14 extending from one end of body section 12, crossbars 18 and 28 being secured to frames 16 and 14, respectively, at the ends thereof opposite the ends on which the frame sections are secured to the body support sections. Crossbar 18 is supported on a block 30 which is secured to the frame section 12 and reinforced by means of a bar 32. A wheel 20 is rotatably mounted on the crossbar 18, wheel 20 having cogs 24 thereon for drivingly engaging water or a planar surface which the wheel 20 may come into contact with. A pulley 36 is connected to wheel 20, the gear 36 being driven by a belt 38 connected to a driving pulley 40 operably secured to a pedal 42. One end of pedal 42 is rotatably journaled in a block 44 extending from the body support section 12 by means of a bar 45. A wheel 22 is rotatably mounted on crossbar 28 and is driven by means of a pulley 46 also rotatably mounted on crossbar 28. A drive belt 48 drivingly engages pulley 46 through a driving pulley 50 operably secured to a pedal 54, one end of which is rotatably journaled in block 44. Wheel 22 has cogs 26 thereon substantially the same as the cogs 24 on wheel 20. The diameter of wheels 20, 22, 68 and 64 are the same.

A frame section 56 and 58 extend from the opposite end of the body supporting board 12, frames 56 and 58 having crossbars 60 and 62 for rotatably mounting wheels 64 and 68. Pulleys 88 and 72 are rotatably mounted on crossbars 68 and 60 drivingly engage wheels 68 and 64. Cogs 66 and 70 are secured to the periphery of the wheels. The pulleys 72 and 88 are operably engaged by means of drive belts 82 and 90 which are driven by pulleys 84 and 92 on pedals 86 and 94. Pedals 86 and 94 are rotatably journaled in a block 78 which extends from the body supporting board 12 by means of a bar 80. The crossbars 62 and 60 are secured in a block 74 bracingly secured to body supporting section 12 by means of a bar 76.

The body supporting board 12 has cut-out sections 13 and 15 thereon for accommodating the body of a person using the apparatus 10 more comfortably. Removable brackets 97, 96, 106 and 104 are provided and are secured to the frame 12 by means of bolts 98 and 108.

Openings 100, 102, 110 and 111 are provided on the ends of the removable brackets for securing the apparatus 10 to a vertical surface such as a wall.

As illustrated in FIG. 1, the crossbars 18 and 28 lie in a plane parallel to the plane of the body supporting section 12 and the crossbars 60 and 62 lie in a plane parallel to the body supporting section 12, the plane in which the crossbars 18 and 28 lie being further extended away from the plane of the body support section 12 than the plane in which the crossbars 60 and 62 lie. The free ends of the removable brackets (i.e., the ends which are not connected to the body support section 12) lie in a common plane, this common plane being parallel to a plane tangent to the periphery of the wheels 20, 22, 64 and 68. This arrangement of the removable brackets and the wheels is maintained so that the body support section 12 will remain substantially on a slant as is illustrated in FIG. 1 whether the apparatus 10 is used in a horizontal or a vertical position.

The apparatus 10 may be made of materials having sufficient buoyancy so that the apparatus will float and the apparatus used as a swimming machine. In this embodiment, the pedals 42 and 54 are hand grasped and rotated individually whereas the pedals 86 and 94 are operated by the feet. The machine is employed to provide either the same amount of exercise to each of the arms and legs of a user or if muscle development in a particular arm or leg is impaired, greater effort may be applied to such arm or leg to improve muscle development such as is the case where the apparatus 10 is used in a physical therapy program. By concentrating on the weaker arm and leg muscles and employing the stronger arm and leg muscles to steer the apparatus 10, the underdeveloped arm and leg muscles may not only be comparably developed but also may be compared by the person using the apparatus 10 to the stronger muscles and thereby determine the muscles that are underdeveloped as well as the degree of underdevelopment. In a prolonged therapy program, persons using the apparatus 10 will be able to also perceive some measures of progress in development of weakened muscles. Additionally, the apparatus 10 may be used by athletes in training such as swimmers to determine if equal effort is being employed in the use of left and right arm and leg muscles in a swimming stroke. If the apparatus 10 is employed and tends to veer either left or right using both arms and both legs or the arms only or legs only, a swimmer in training would be able to determine if their arm stroke and leg kick is developed by a substantially equal amount of force applied by each arm and leg in the course of a stroke. Similarly, the veering of the apparatus when used as a swimming machine in a physical therapy program, indicates not only muscles that may be underdeveloped but also progress in developing muscles when used over a long period of time.

The apparatus 10 may also be employed on a vertical surface to vertically exercise arm and leg muscles. The relative length of time which each of the arms and legs are capable of applying a moving force to the wheels of the apparatus can be used to determine if all arm and leg muscles are developing approximately the same amount of energy. If an arm or a leg becomes overly tired before the other arm or leg, greater emphasis on the underdeveloped arm or leg may be made in order to develop it up to a level comparable to the arm or leg which does not tire as quickly. In this respect, the apparatus 10 may be used either as a muscle development apparatus for athletes or in physical therapy programs for persons who have sustained some type of muscle and/or nerve injury.

Although the apparatus has been described by reference to some embodiments, it is not intended that the novel swimming and exercising apparatus be limited thereby but that modifications thereof are intended to be included as falling within the broad spirit and scope of the foregoing disclosure, the following claims and the appended drawing.

What is claimed is:

1. A swimming and exercising apparatus comprising a substantially flat body supporting section, first and second frame sections extending from opposite ends of said body supporting section, each of said frame sections comprising a pair of lateral arms secured at one end thereof to said body section, a crossbar joining the other end of said lateral arms of each of said frame sections, said crossbar of said first frame lying in a first horizontal plane parallel to said body supporting section, the crossbar of said second frame lying in a second horizontal plane parallel to said body supporting section, said second horizontal plane being closer to said body supporting section than said first horizontal plane, wheel means rotatably mounted on each crossbar of each of said frame sections, said wheel means comprising a pair of opposed wheels on the crossbar of said first frame and a pair of opposed wheels on the crossbar of said second frame, cog means extending from the periphery of each of said wheel means for drivingly engaging water or a planar surface which said wheel means may engage, first and second pedal means mounted substantially at the ends of said body supporting section in the area where said first and second frame sections extend from said body supporting section, said first pedal means aligned with said crossbar of said first frame and arranged to be operated by hand, said second pedal means aligned with said crossbar of said second frame means arranged to be operated by foot, said first pedal means drivingly connected to said wheel means on said first frame for individually driving each of said wheels on said first frame, said second pedal means drivingly connected to said wheel means on said second frame for individually driving each of said wheels on said second frame so that greater or lesser exercising forces may be applied independently to each of said wheels by said first pedal means and said second pedal means.

2. The apparatus of claim 1 further comprising bracket means for mounting said apparatus on a vertical wall so that said apparatus may be employed as an exercising machine for vertically exercising arm and leg muscles.

3. The apparatus of claim 2 where said bracket means comprises a first bracket and a second bracket extending from the same side of said body supporting section, the ends of said brackets extending away from said body supporting section lying in a common plane, said common plane being parallel to a plane tangent to the periphery of said wheel means.

4. The apparatus of claim 1 where said wheel means comprise a plurality of wheels, each wheel having the same diameter.

* * * * *